US007059560B2

(12) United States Patent
Ljungberg et al.

(10) Patent No.: US 7,059,560 B2
(45) Date of Patent: Jun. 13, 2006

(54) SYSTEM FOR DETERMINING THE TARGET RANGE FOR A LASER GUIDED WEAPON

(75) Inventors: Peter Ljungberg, Gothenburg (SE); Christer Regebro, Eskilstuna (SE)

(73) Assignee: SAAB AB, Linkoping (SE)

( * ) Notice: Subject to any disclaimer, the term of this patent is extended or adjusted under 35 U.S.C. 154(b) by 0 days.

(21) Appl. No.: 11/160,265

(22) Filed: Jun. 16, 2005

(65) Prior Publication Data

US 2006/0076455 A1 Apr. 13, 2006

(30) Foreign Application Priority Data

Jun. 18, 2004 (EP) ..... 04014282.0

(51) Int. Cl.
*F41G 7/00* (2006.01)
*F41G 7/24* (2006.01)

(52) U.S. Cl. ..... 244/3.13; 244/3.1; 244/3.11; 244/315; 244/3.16; 356/3; 356/4.01; 356/5.01

(58) Field of Classification Search ..... 244/3.1–3.3; 342/52–58, 61, 62, 68, 118, 119, 147, 175, 342/195; 356/3, 4.01–5.15
See application file for complete search history.

(56) References Cited

U.S. PATENT DOCUMENTS 3,729,150 A * 4/1973 Conger ..... 244/3.13
3,964,695 A * 6/1976 Harris ..... 244/3.16
4,143,835 A 3/1979 Jennings, Jr. et al.
4,231,533 A 11/1980 Durig
4,324,491 A * 4/1982 Hueber ..... 244/3.13
4,497,065 A * 1/1985 Tisdale et al. ..... 244/3.15
6,060,703 A 5/2000 Andressen
6,204,801 B1 3/2001 Sharka et al.
6,262,800 B1 * 7/2001 Minor ..... 244/3.13
6,626,396 B1 * 9/2003 Secker ..... 244/3.16
6,919,840 B1 * 7/2005 Friedrich et al. ..... 342/68

* cited by examiner

*Primary Examiner*—Bernarr E. Gregory
(74) *Attorney, Agent, or Firm*—Albihns Stockholm AB

(57) ABSTRACT

A system for determining the distance between a target (4) and a laser guided weapon traveling towards the target (4). The system (1) comprises a laser designator (5) on a remote platform (2) for radiating a first train of pulses (l1) on a set wavelength in the direction of the target (4). In the weapon (3) a receiver (6) is arranged to receive and detect pulses on the set wavelength reflected from the target (4). There is also a direction sensing means in the weapon (3) for determining the direction of the target (4). A transmitter (7) is arranged in the weapon (3) to periodically transmit a second train of pulses (l2) on the set wavelength in the direction of the target (4). There are means in the receiver (6) to extract a reflection from the target (4) of the second train of pulses (l2). There are further timing means to determine the period of time from transmitting the second train of pulses (l2) to receiving the reflection from the target (4) of the second train of pulses (l2). Computing means (8) are arranged for determining a distance corresponding to said period of time.

16 Claims, 1 Drawing Sheet

SYSTEM FOR DETERMINING THE TARGET RANGE FOR A LASER GUIDED WEAPON

FIELD OF THE INVENTION

Figure 1:
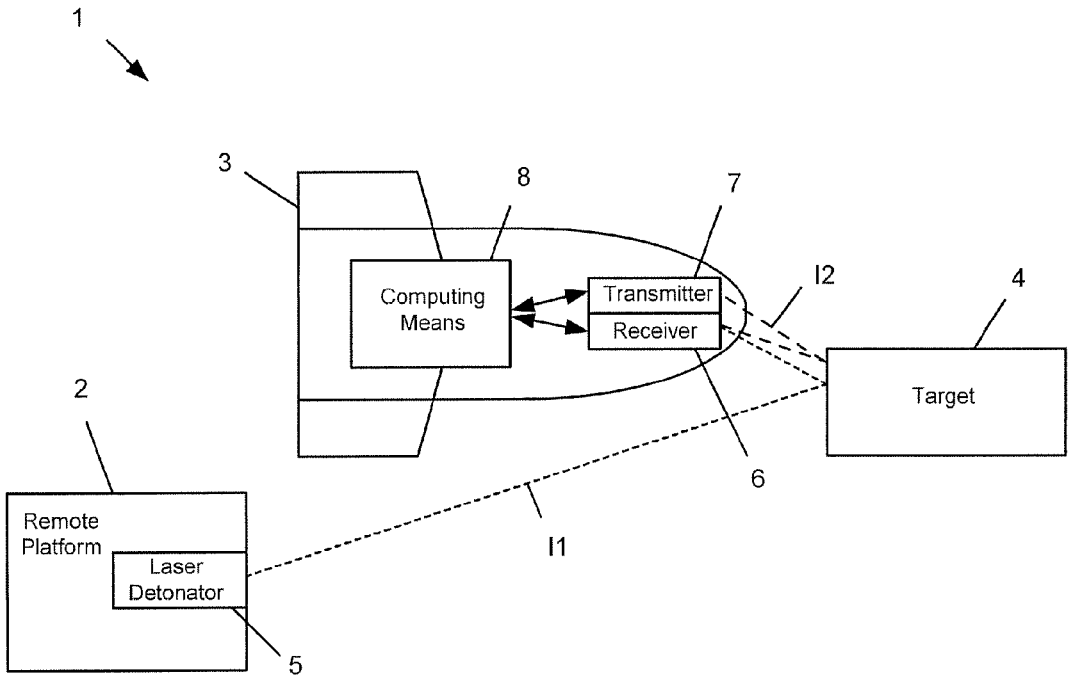

The invention relates to a system for determining the distance between a target and a laser guided weapon traveling towards the target.

BACKGROUND OF THE INVENTION

Precision weapons play a significant role in battlefield success by providing improved weapon accuracy and allow a much lighter launch vehicle for corresponding effectiveness with an unguided system. One example of a precision weapon is a missile.

Laser guided weapons are used in a variety of applications which often require accurate target closing rate and closing distance information to successfully direct the weapon to its target. Poor or corrupted closing rate and/or range information may cause warhead misalignment, premature detonation or targeting error.

In active guidance systems a transmitter onboard the laser guided weapon facilitates ranging—determination of the distance between the weapon and the target. By measuring the round trip signal travel time for a signal transmitted via the transmitter and reflected back from the target a range estimate is obtained. The active guidance systems are primarily advantageous in areas where no man-assisted guidance is possible. However, these types of systems are usually less accurate than systems that include targeting by an operator.

Semi-active systems utilize a remote platform with an illumination source or transmitter. Operation of the illumination source or transmitter is usually man-assisted in order to achieve the best accuracy in the targeting. However, the illumination source may also be automatically operated from the remote platform. In a semi-active laser guidance system, the illumination source radiates a beam of pulsed energy toward a target or a chosen spot on the target. The beam is typically generated and transmitted from a laser designator platform. The illumination source marks the target for the weapon which homes in on the reflected laser energy to strike the target. Semi-active guidance systems enable the laser guided weapon to sense the direction of the target and to direct the course of the weapon in the direction of the target. However, these types of systems usually lack the ability to accurately determine range when a target is in motion. Range estimated by the state-of the art semi-active guidance systems is often grossly inaccurate and can result in inefficient weapon guidance, increased fuel consumption and mistimed weapon detonation. To facilitate the determination of the remaining distance before hitting the target, many laser guided weapons also includes a position indicating system or other additional guidance means, i.e., inertial reference units.

U.S. Pat. No. 6,204,801 to Sharka et al. discloses a system for determining the range between a missile and a target adapted for use with a semi-active missile system. The receiver system in the missile includes two receivers in order to be able to produce range information for the target on the basis of a frequency modulated periodic signal from the illuminating system. The semi-active missile system is a radar based system and the disclosed solution would not be applicable in a laser based system. The solution requires that both the missile and the target are illuminated by the same illumination system, which is incompatible with the concept of semi-active laser targeting.

SUMMARY OF THE INVENTION

It is an object of the present invention to provide an improved solution for determining the distance between a target and a laser guided weapon traveling towards the target.

This object is achieved through the inventive system in accordance with claim 1. A laser designator on a remote platform is arranged to radiate a first train of pulses on a set wavelength in the direction of the target. A receiver in the laser guided weapon receives and detects pulses on the set wavelength reflected from the target. A direction sensing means in the laser guided weapon determines the direction of the target. The laser guided weapon includes a transmitter which periodically transmits a second train of pulses on the set wavelength in the direction of the target. The receiver in the laser guided weapon includes means to extract a reflection from the target of the second set of pulses. The weapon further includes timing means to determine the period of time from transmitting the second train of pulses to receiving the reflection from the target of the second train of pulses. Computing means are arranged in the laser guided weapon for determining a distance corresponding to said period of time.

The laser guided weapon includes means for adjusting the direction of the laser beam emitted from the transmitter in the laser guided weapon so that the laser beam of the second train of pulses is sent in the direction of the target. The direction to the target is determined in the computing means in the laser guided weapon.

In a preferred embodiment of the invention, the laser guided weapon includes optical or mechanical means for directing the laser beam of the second train of pulses in the direction of the target.

The inventive system may be used when the semi-active system is based on illumination from a mobile platform as well as from a stationary platform.

BRIEF DESCRIPTION OF THE DRAWINGS is a view of a semi-active guidance system of an embodiment of the present invention including a platform with a laser designator, a laser guided weapon and a target.

DETAILED DESCRIPTION OF THE PREFERRED EMBODIMENT OF THE INVENTION

FIG. 1 is an overview of the semi-active guidance system 1 of an embodiment of the present invention showing a mobile platform 2 with a laser designator 5, a laser guided weapon 3 and a target 4. The laser designator 5 is arranged on a platform 2 including a launching system, e.g., a fighter aircraft. The laser designator 5 emits a narrow beam of laser pulses from a pulsed laser signal generator. When within range, the laser designator 5 can be aimed so the energy precisely designates a chosen spot on the target 4.

The laser designator 5 emits a narrow collimated beam of laser pulses. The laser pulses are single color, i.e. emitted on a set wavelength. The chosen wavelength determines whether the sensor is visible to human eye or a specific sensor.

The laser guided weapon 3 includes a laser seeker with a receiver 6. The weapon 3 is headed to the target 4 from a known direction. For maximum effectiveness, the designator 5 should be aligned so that reflection is the strongest in the receiver 6. The laser designator may be operated by from a ground-based platform or from a flying platform.

The receiver 6 may be arranged as a photodiode detector with detector elements arranged in at least two directions or as an array of photodiodes. The computing means 8 establishes the direction to the target from knowledge of how energy reflected from the target is distributed in the detector elements. The receiver 6 in the laser guided weapon 3 looks for laser designator 5 energy on a specific code. The designator 5 and the receiver 6 work together as a team on a specific code so that the receiver 6 only detects a designator 5 set on the specified code.

The designator 5 transmits a laser beam including a first train of pulses l1 on a set wavelength in the direction of the target 4. The pulsed laser beam has a frequency in the order of 10–1000 Hz. A commonly used wavelength in a laser designator 5 is 1064 nm. Other wavelengths are of course also possible within the scope of the invention.

The receiver 6 is dedicated for receiving the first train of pulses l1. The receiver 6 has a limited field of view and should be oriented so that the target 4 falls within that field of view. When a laser pulse has been detected from the first train of laser pulses l1 in the receiver 6, computing means 8 in the missile establishes the direction to the target 4. The laser guided weapon, may then be re-oriented so that the receiver 6 is aligned with the laser pulses reflected in the target.

The laser guided weapon 3 also includes a transmitter 7 for emitting a laser beam in the form of a second train of pulses l2 on the wavelength of the target designator 5 in the direction of the target 4. The second train of pulses l2 has a frequency in the order of 10–1000 Hz and is adjusted to the first train of pulses l1 so that no interference occurs between the train of pulses from the laser designator 5 and the train of pulses from the transmitter 7 in the laser guided weapon 3. The transmitter is directed so that the second train of pulses l2 is reflected in the target and detected in the receiver 6 of the laser guided weapon 3. In a first embodiment of the invention, optical means are arranged for adjusting the direction of the laser beam so that the laser beam falls on the target 4. It is also possible to include mechanical means to direct the laser beam on the target 4. The computing means 8 controls the optical or mechanical means for adjusting the direction of the laser beam.

The second train of pulses l2 is coded and the receiver 6 in the semi-active seeker is adjusted to be able to detect this second train of pulses l2. The wavelength of the second train of pulses l2 may either coincide with the wavelength of the first train of pulses l1 or be set to any other wavelength that may be detected by the receiver 6 in the weapon 3. In a preferred embodiment of the invention, the receiver has the capability to detect the set wavelength.

When a laser pulse is emitted from the transmitter 7 in the weapon 3 toward the target 4, the timing of the pulse is initiated by the computing means 8. The timing may be executed within the computing means 8 or within the receiver 6.

The laser beam falls on the target 4 and is at least partly reflected to the receiver 6 in the semi-active target seeker in the weapon. When the receiver 6 detects the second train of laser pulses l2, the timing is aborted. The time interval from sending the second train of pulses l2 to receiving the reflected beam is determined. The computing means 8 determines the distance to the target 4 from the time interval between emitting the laser pulse in a second train of laser pulses l2 and receiving the reflected pulse. The distance information from two successive pulses may also be determined. This information is used to establish the closing rate between the weapon 3 and the target 4. The computing means 8 may also calculate the time remaining until impact between the weapon 3 and the target 4 from the prevailing distance and closing rate.

What is claimed is:

1. A system for determining the distance between a target and a laser guided weapon traveling towards the target comprising:

a laser designator on a remote platform for radiating a first train of pulses on a set wavelength in the direction of the target;

a receiver in the weapon to receive and detect pulses on the set wavelength reflected from the target;

a direction sensing means in the weapon for determining the direction of the target;

a transmitter in the weapon to periodically transmit a second train of pulses on the set wavelength in the direction of the target;

means in the receiver to extract a reflection from the target of the second train of pulses;

timing means to determine the period of time from transmitting the second train of pulses to receiving the reflection from the target of the second train of pulses; and computing means for determining a distance corresponding to said period of time.

2. The system according to claim 1, wherein the first and second trains of pulses are pulsed laser beams with a first and second frequency.

3. The system according to claim 2, wherein the laser beams are narrow, collimated beams.

4. The system according to claim 3, wherein optical means in the weapon is arranged to direct the laser beam of the second train of pulses in the direction of the target.

5. The system according to claim 3, wherein mechanical means in the weapon is arranged to direct the laser beam of the second train of pulses in the direction of the target.

6. The system according to claim 1, wherein the pulse frequency of the second train of pulses is adjusted to the pulse frequency of the first train of pulses.

7. The system according to claim 1, wherein time shift means are used for measuring a time delay between emission of a pulse of the second train of pulses and reception by the receiver of said pulse after reflection on the target.

8. The system according to claim 7, wherein a distance between the weapon and target is determined from the delay.

9. The system according to claim 7, wherein a closing rate between the weapon and the target is determined from the determined distance information in successive pulses.

10. The system according to claim 9, wherein the time remaining until impact between the laser guided weapon and the target is determined from the distance and closing rate information.

11. The system according to claim 10, wherein the computing means optimizes guidance of the weapon and detonation of a weapon warhead based on the distance, closing rate and remaining time information.

12. The system according to claim 1, wherein the remote platform is a mobile platform such as an aircraft.

13. The system according to claim 1, wherein the remote platform is a stationary platform.

14. A method for determining the distance between a target and a laser guided weapon using a semi-active guidance system comprising the steps of:

radiating a first train of pulses on a set wavelength from a remote platform in the direction of the target;

receiving the first train of pulses reflected from the target in the laser guided weapon;

determining the direction of the target from direction sensing means in the laser guided weapon;

transmitting periodically from the laser guided weapon a second train of pulses on the set wavelength in the direction of the target;

extracting the second train of pulses reflected from the target in the laser guided weapon;

determining the period of time from transmitting the second train of pulses to receiving the reflection from the target of the second train of pulses using timing means in the laser guided weapon; and determining the distance between the laser guided weapon and the target from said determined period of time using computing means in the laser guided weapon.

15. The method according to claim 14, wherein the direction of the laser beam emitted from the transmitter in the laser guided weapon is adjusted so that the laser beam of the second train of pulses is accurately sent in the direction of the target.

16. The method according to claim 14, wherein in the transmitting step the second train of pulses is directed to the target by optical or mechanical means within the laser guided weapon.

* * * * *